United States Patent [19]

Perronin et al.

[11] 3,978,016

[45] Aug. 31, 1976

[54] PIGMENTARY PRINTING PASTES FOR TEXTILES

[75] Inventors: Jean Perronin, Chantilly; Rene Paul Auguste Decamp, Villers Saint Paul, both of France

[73] Assignee: Produits Chimiques Ugine Kuhlmann, Paris, France

[22] Filed: Apr. 26, 1974

[21] Appl. No.: 464,727

[30] Foreign Application Priority Data

Apr. 27, 1973 France ..... 73.15341

[52] U.S. Cl. ..... 260/29.6 TA; 8/62; 260/29.4 UA; 260/29.7 T; 260/42.21; 260/42.55

[51] Int. Cl.[2] ..... C08L 31/04

[58] Field of Search ..... 260/29.6 TA, 29.4 UA, 260/29.7 T, 42.21, 42.55; 8/62

[56] References Cited

UNITED STATES PATENTS

| | | | |
|---|---|---|---|
| 2,719,831 | 10/1955 | Craemer et al. | 260/29.4 UA |
| 2,991,260 | 7/1961 | Auer et al. | 260/29.4 UA |
| 3,002,939 | 10/1961 | Balassa | 260/29.4 UA |
| 3,258,443 | 6/1966 | Cantor et al. | 260/29.6 TA |
| 3,296,169 | 1/1967 | Corey | 260/29.6 TA |
| 3,484,420 | 12/1969 | Chihara | 260/29.6 TA |
| 3,770,680 | 11/1973 | Iacoviello | 260/29.6 TA |

FOREIGN PATENTS OR APPLICATIONS

| | | | |
|---|---|---|---|
| 38-24797 | 11/1963 | Japan | 8/62 |
| 1,209,241 | 10/1970 | United Kingdom | 8/62 |

*Primary Examiner*—Eugene C. Rzucidlo
*Attorney, Agent, or Firm*—Beveridge, DeGrandi, Kline & Lunsford

[57] ABSTRACT

Aqueous pigmentary printing pastes for textile fibers containing a pigment and a thickener in which the thickener is a latex, having a proportion of dry material of from 30% to 50%, of a water-soluble copolymer having a glass transition temperature of from 20°C to 100°C and containing in interpolymerized form the following components: (a) 40% to 60% by weight of acrylic acid, methacrylic acid, crotonic acid or mixtures thereof; (b) 10% to 30% by weight of a vinyl ester of an organic or mineral acid; (c) 50% to 30% by weight of one or more ethylenic monomers, other than the above-mentioned esters, which form water-insoluble homopolymers; (d) 0% to 5% by weight of one or more monomers containing an ethylenic linkage and one or more polar groups; and (e) 0% to 5% by weight of one or more monomers containing several ethylenic linkages; the proportion of said latex in the pastes being 0.5% to 15% and said copolymers being partially or totally neutralized.

7 Claims, No Drawings

PIGMENTARY PRINTING PASTES FOR TEXTILES

The present invention relates to pigmentary printing pastes for textiles, which contain as thickener a water-soluble copolymer.

Usually pigmentary printing pastes consist essentially of one or more binding agents, a dispersion of pigments and various adjuvants, such as: surface-active compounds, plasticisers, softeners, buffers, and catalysts. In order to obtain a suitable viscosity, an emulsion of the "oil-in-water" or "water-in-oil" type is made from these different constituents by means of a solvent which is generally an aliphatic hydrocarbon the boiling point of which is between 140° and 220°C. such as white spirit.

The use of these pastes has the disadvantage, at the moment of printing and during the thermal treatment which follows the printing, of liberating solvent vapours, which results in pollution of the atmosphere and the risk of fire.

In order to mitigate these disadvantages, it has been proposed to stop the use of these solvents or, at least, to operate with restricted amounts by employing as thickener natural or synthetic colloids such as alginates, carboxymethyl-cellulose or alkali metal salts of carboxylic acid polymers such as ammonium or sodium polyacrylates.

Later the use of copolymers prepared from 10% to 40% of acrylic or methacrylic acid, less sensitive to water than the above colloids, was proposed in French Pat. No. 1,556,659.

Unfortunately, these products do not allow the colouristic effect of the pigment to be sufficiently emphasized. The coloured designs, printed with these colloids have a depth of tone which is very inferior to that obtained on using conventional printing pastes prepared by means of an emulsion. The same thing applies with regard to the brightness of the colours obtained.

Finally, if it is desired to avoid obtaining prints which are too dull, it is known that, for a given viscosity, the least possible dry materials must be used. In this case and with the above thickeners, a bad retention of the aqueous phase follows which leads, especially on artificial or synthetic fibres, to spreading or running phenomena and to prints of which the outlines are not very sharp.

We have found that it is possible to obtain bright prints with good colouristic yields by using pigmentary printing pastes containing as thickener a latex of a water-soluble copolymer consisting of an aqueous dispersion of a copolymer having a vitreous transition temperature of from 20° to 100°C., preferably from 50° to 100°C., and which contains in interpolymerised form:

a. 40% to 60% by weight of acrylic and/or methacrylic and/or crotonic acid
b. 10% to 30% by weight of a vinyl ester of an organic or mineral acid
c. 50% to 30% by weight of one or more ethylenic monomers, other than the above-mentioned esters, forming waterinsoluble homo-polymers.
d. 0% to 5% by weight of one or more monomers having an ethylenic linkage and one or more polar groups.
e. 0% to 5% by weight of one or more monomers having several ethylenic linkages, the pH of the dispersion being from 2 to 5 and the proportion of dry material being from 30% to 50%, preferably, from 35% to 45%. All percentages in this specification are by weight unless otherwise indicated. The water-soluble copolymer may be one which is solubilized in water by the action of a basic agent.

Finally, these dispersions have the property of thickening greatly on being rendered alkaline, giving colloidal solutions of which the viscosity with 2% of dry material is from 300 to 2000 cps, preferably from 700 to 1500 cps.

The copolymers according to the invention may be obtained for example by emulsion copolymerisation of the monomers in an aqueous phase according to the known processes, or by means of suitable surface-active compounds and/or colloids. These may have an anionic and/or non-ionic character and examples are the alkylsulphates of an alkali metal such as sodium dodecylpolyglycol ether sulphate and sodium sulpho ricinoleate, the alkylsulphonates such as the alkali metal salts of sulphonated paraffins, the salts of fatty acids such as sodium laurate, or triethanolamine oleate or abietate, the alkylarylsulphonates such as sodium dodecylbenzenesulphonate or the alkali metal sulphates of ethoxylated alkylphenols. Examples of non-ionic emulsifiers are the condensation products of ethylene oxide with fatty alcohols, alkylphenols, polypropyleneglycols, or fatty amines, amides or acids, such as oleyl alcohol condensed with 20 moles of ethylene oxide or lauryl alcohol or nonylphenol condensed with 10 moles of ethylene oxide. The fatty esters of polyols such as anhydrosorbitol monooleate or glycerol monolaurate may also be used.

Jointly with these surface-active compounds may be used other ingredients well known in the art of emulsion polymerisation such as chelating agents, buffers, salts or mineral or organic acids, solvents, adjuvants capable of regulating the pH, or hydrotropic or stabilising agents.

Examples of vinyl esters which may be used according to the invention are vinyl chloride, vinyl acetate, vinyl propionate, vinyl butyrate, vinyl isobutyrate, vinyl octanoate, vinyl laurate, vinyl stearate, or vinyl esters of the acids known on the market by the name of Versatic acids.

Examples of monomers which form water-insoluble homopolymers are the esters of acrylic and/or methacrylic acids, for example methyl, ethyl, butyl, isobutyl, hexyl or 2-ethylhexyl acrylates, lauryl or stearyl methacrylates or cellosolve acrylate. Other examples are ethylene and its derivatives such as propylene, isobutylene, acrylonitrile, vinylidene halides such as vinylidene chloride, styrene, vinyl-toluene or alpha methyl styrene.

Examples of copolymerisable compounds having an ethylenic linkage and polar groups, are hydroxyalkyl acrylates or methacrylates such as ethyleneglycol monoacrylate, propylene-glycol monomethacrylate, allyl alcohol, allyl glycollate, isobutene-diol, acrylamide, methacrylamide, maleamide, maleimide, N-methylol acrylamides or methacrylamides, N-isopropyl acrylamide, sodium acrylate or methacrylate, vinylsulphonic or styrene parasulphonic acids or their alkali metal salts, acrylonitrile, methacrylonitrile, 3-aminocrotonitrile, glycidyl acrylate or methacrylate, alkoyl cyanoacrylates such as isopropyl cyanoacrylate or 2-cyano-3-(dimethylamino)ethyl acrylate, methylene glutaronitrile, cyanoethyl acrylate, dimethyl aminoethyl acrylate or methacrylate, acrolein, vinylpyridines, N-vinyl-pyrrolidone, N-vinyl-carbazole, 2-chloro-acrylonitrile, acrylyl chloride, or diacetone acrylamide.

Examples of monomers having several ethylenic linkages are allyl acrylate or methacrylate, tetra-allyloxyethane, ethyleneglycol or propyleneglycol diacrylates or dimethacrylates, divinyl benzene, vinyl seneciotate, divinyl carbinol, triacryloyl-hexahydro-triazine, butadiene, chlorobutadienes or isoprene.

The proportion of dry material in the dispersions of copolymers that may be used in this invention may vary within the very wide limits of from 30% to 50% and is preferably from 35% to 45%.

The term "glass transition temperature" indicates a transition temperature of the second order which is a specific and characteristic property of each polymer. It is the temperature at which a polymer passes from a rigid glassy state to a plastic or rubbery state. It corresponds to the change of slope or course of the diagrams representing the variation of certain physical or mechanical properties of the elastomers as a function of the temperature (Bovey, Kolthoff, Medalia, Meehan, page 323 in "Emulsion polymerisation", 1955). For the copolymers that may be used in the present invention, this temperature has been determined by measuring the modulus of rigidity in torsion according to the standard A.S.T.M. D.1043-61 T (corresponding French Standard B. N. M. P. 1005/4).

In order to provide compositions which are more easy to use or more adapted to obtain particular effects, the latexes thus obtained may be mixed for example with adjuvants such as surface-active compounds, hygroscopic agents, plasticisers, softeners, foam-inhibiting agents, cross-linking agents, aminoplast condensates, catalysts, or natural or synthetic binders.

These compositions or latexes, after partial or total neutralisation by a basic agent, such as for example ammonia, soda or trietnanolamine, are advantageously used to prepare pigmentary printing pastes. These may contain from 0.5% to 15% preferably 2% to 8% of these latexes.

It has been found that these pastes, even in the presence of a small quantity of a copolymer according to the invention, have very high viscosities and particular rheological properties, which allow them to be called "pseudo-plastics". The viscosity of these pastes decreases when they are subjected to shearing stresses and a better supply of the paste at the moment of the printing follows. On the contrary, at rest, when the paste has just been deposited on its support, its viscosity resumes a higher value and the paste remains thus preferably at the surface. After drying, it then gives a very high colouristic yield. For the same reasons and especially on synthetic fibres, the designs printed under these conditions show very sharp outlines.

In order to obtain certain effects, these printing pastes may possibly include a certain quantity of emulsion based on a solvent such as for example, white spirit. Under these conditions, the total amount of solvent used is less than in a conventional paste. In addition, it has been found that the presence of a copolymer according to the invention facilitates printing, especially when this is effected by means of a frame. In particular, the emulsions are more stable, the colours dry less readily in engravings and the frames have in consequence less tendency to become stopped up. This property is advantageous, for example, in the case where the printing machine has to be stopped for some moments.

The invention is illustrated by the following Examples in which the parts indicated are parts by weight and the temperature is in degrees Centigrade.

EXAMPLE 1

With a latex, containing 35% of dry materials and having a pH of 3.5, of a copolymer I obtained by emulsion copolymerisation of:

41% of methacrylic acid
42.4% of butyl acrylate
13.5% of vinyl acetate
2% of ethyleneglycol dimethacrylate
1.1% of a N-methylol acrylamide, and having a vitreous transition temperature of 68° and which enables a colloidal solution having a viscosity from 1,120 cps at 20° to be obtained from a mixture such as:

| | |
|---|---|
| 35% Latex | 5.7 g (2g of dry material) |
| Water | 92.8 g |
| Ammonia 28° Be | 1.5 g. |
| | 100 g. |

a printing paste A in accordance with this invention is prepared in the absence of white spirit.

For this, the following components are mixed with vigorous stirring:

| | |
|---|---|
| Latex of copolymer I above (35% dry material) | 41 g. (14 g. of dry material) |
| Water | 898 g. |
| Ammonia 28° Be | 11 g. |
| Aqueous dispersion of 20% copper phthalocyanine | 60 g. |

The paste obtained is printed on cotton, staple fibreviscose, polyamide, polyester and silk fabrics. After drying at 50°C. these fabrics are thermoset for 5 minutes at 140°C. According to the present invention, the printed designs are bright, have a good colouristic yield, show good levelling and sharp outlines.

Under the same conditions as above, another printing paste B is prepared by replacing the 14 g of the copolymer I by 14 g of a copolymer II, obtained by emulsion polymerisation of:

16% of acrylic acid
81.9% of ethyl acrylate
0.1% of 1,4-butanediol dimethacrylate
2% of N-methylol methacrylamide, having a vitreous transition temperature of −18° and which gives at 2% in ammoniacal medium, a colloidal solution with a viscosity of 40 cps at 20°.

When this paste B is applied under the same conditions as paste A above it has a tendency to spread at the moment of printing and gives, more particularly on viscose, silk, polyamide and polyester, designs of which the outlines are not sharp. In addition, the colouristic yield and the brightness of the prints are distinctly inferior to those obtained with paste A which contains the latex I according to the invention.

It is found that, with the latter, printing paste A behaves like a "pseudo-plastic" fluid and that the viscosities obtained are much higher.

Viscosities taken on the Brookfield R V T viscosimeter at 20° (in centipoises)

| Speed of the moving parts in r.p.m. | Paste A | Paste B | Paste C |
|---|---|---|---|
| 0.5 | 270,000 | 17,000 | 140,000 |
| 1 | 150,000 | 10,500 | 80,000 |
| 2.5 | 68,000 | 5,200 | 40,000 |
| 5 | 38,000 | 3,100 | 24,000 |
| 10 | 20,500 | 1,875 | 14,000 |
| 20 | 10,600 | 1,150 | 8,250 |
| 50 | 4,640 | 610 | 4,100 |
| 100 | 2,550 | 390 | 2,500 |

In order to obtain outlines as sharp and an identical viscosity (at 100 r.p.m.), a printing paste C must be prepared with 33 g of copolymer II say about 2.3 times more than of copolymer I. But nevertheless, under these conditions, the printed designs still have a colouristic yield distinctly less than that obtained with paste A.

Finally, a copolymer III, obtained by emulsion copolymerisation of:

16% of acrylic acid
81.9% of ethyl acrylate
0.1% of ethyleneglycol dimethacrylate
2% of N-methylol acrylamide, having a vitreous transition temperature of −17° and which gives at 2% in ammoniacal medium a colloidal solution with a viscosity of 60 cps at 20° leads to a printing paste D which gives results approximately identical with those obtained with copolymer II.

EXAMPLE 2

With a latex containing 35% of dry material of a copolymer IV obtained by emulsion copolymerisation of:

41% of methacrylic acid
45.1% of butyl acrylate
13.9% of vinyl acetate, having a vitreous transition temperature of 83° and which gives at 2% in ammoniacal medium a colloidal solution with a viscosity of 310 cps at 30°, a printing paste E in accordance with the invention is prepared, in the absence of white spirit.

For this, the following components are mixed with vigorous stirring:

| | |
|---|---|
| Latex of copolymer IV above (35% dry materials) | 54 g. (19 g. of dry materials) |
| Water | 881 g. |
| Ammonia 28° Be | 15 g. |

Aqueous dispersion (20%) of a pigment obtained by coupling the diazo derivative of 2,4,5-trichloro-aniline with N-(2-methyl-phenyl)-2-hydroxy-1-naphthalenecarboxamide . . . . . 60 g The viscosities of this printing paste (taken on the Brookfield R V T viscosimeter) at 20° are as follows:

| | | |
|---|---|---|
| at 0.5 | r.p.m. | 82,000 cps |
| at 10 | r.p.m. | 16,400 cps |
| at 100 | r.p.m. | 4,000 cps |

This printing paste is printed on cotton, staple fiber-viscose, polyamide and polyester fabrics. After drying at 50° these fabrics are thermoset for 5 minutes at 140°. The designs thus printed are bright and endowed with a good colouristic yield. The prints show sharp outlines.

EXAMPLE 3

A printing paste F is prepared with the latex of copolymer IV described in Example 2, without white spirit. For this, the following components are mixed with vigorous stirring:

| | |
|---|---|
| Latex of copolymer IV (35%) dry material) | 80 g. (28 g. of dry material) |
| Water | 690 g. |
| 15% ammonium sulphate | 10 g. |
| 28° Be ammonia | 20 g. |
| 40% latex of a copolymer prepared from: 67% of ethyl acrylate 31.5% of ethyl methacrylate and 1.5 % of acrylic acid | 120 g. |
| Precondensate of 65% trimethyl-hexamethylol-melamine | 20 g. |
| 20% aqueous dispersion of a pigment obtained by coupling the diazo derivative of 2,4,5-trichloroanilino with N-(2-methyl-phenyl)-2-hydroxy-1-naphthalenecarboxamide | 60 g. |

The viscosities of this printing paste (taken on the Brookfield R V T viscosimeter at 20° are the following:

| | | |
|---|---|---|
| at 0.5 | r.p.m. | 136,000 cps |
| at 10 | r.p.m. | 17,000 cps |
| at 100 | r.p.m. | 4,400 cps |

This paste is printed on cotton, staple fibre, viscose, polyamide, polyester and silk fabrics. After drying at 50° these fabrics are thermoset for 5 minutes at 140°C. The designs thus printed are bright, endowed with a good colouristic yield and are fast to dry and wet tests. The prints show sharp outlines.

We claim:

1. Aqueous pigmentary printing pastes for textile fibers containing a pigment and a thickener in which the thickener is a latex, having a proportion of dry material of from 30% to 50%, of a water-soluble copolymer having a glass transition temperature of from 20°C to 100°C and containing in interpolymerized form the following components:

a. 40% to 60% by weight of acrylic acid, methacrylic acid, crotonic acid or mixtures thereof;
b. 10% to 30% by weight of a vinyl ester of an organic or mineral acid;

c. 50% to 30% by weight of one or more ethylenic monomers, other than the above-mentioned esters, which form water-insoluble homopolymers;

d. 0% to 5% by weight of one or more monomers containing an ethylenic linkage and one or more polar groups; and e. 0% to 5% by weight of one or more monomers containing several ethylenic linkages;

the proportion of said latex in the pastes being 0.5% to 15% and said copolymer being partially or totally neutralized.

2. Pastes according to claim 1 which also contain at least one binder, cross-linking agent, aminoplast condensate or catalyst.

3. Pastes according to claim 1 in which the vitreous transition temperature of the copolymer is from 50° to 100° C.

4. Pastes according to claim 1 in which the proportion of dry material in the latex is from 35% to 45%.

5. Pastes according to claim 1 in which the copolymer is a copolymer of methacrylic acid, butyl acrylate, vinyl acetate, ethyleneglycol dimethacrylate and N-methylolacrylamide.

6. Pastes according to claim 1 in which the copolymer is a copolymer of methacrylic acid, butyl acrylate and vinyl acetate.

7. Pastes according to claim 1 containing 2% to 8% of the latex.

* * * * *